US008313130B2

(12) United States Patent
Hazel

(10) Patent No.: US 8,313,130 B2
(45) Date of Patent: Nov. 20, 2012

(54) TOILET SUPPORT AND TRANSPORTING APPARATUS AND METHOD

(76) Inventor: Archie Hazel, Jonesboro, IL (US)

( * ) Notice: Subject to any disclaimer, the term of this patent is extended or adjusted under 35 U.S.C. 154(b) by 380 days.

(21) Appl. No.: 12/722,356

(22) Filed: Mar. 11, 2010

(65) Prior Publication Data

US 2011/0221218 A1 Sep. 15, 2011

(51) Int. Cl.
*B65G 7/12* (2006.01)

(52) U.S. Cl. ..... 294/15; 294/144

(58) Field of Classification Search ..... 294/15, 294/144, 145, 169, 142; 4/252.1
See application file for complete search history.

(56) References Cited

U.S. PATENT DOCUMENTS

| | | | | |
|---|---|---|---|---|
| 2,148,439 | A * | 2/1939 | Crawford | 206/216 |
| 3,179,287 | A * | 4/1965 | Rickmeier, Jr. | 220/324 |
| 3,648,909 | A * | 3/1972 | Wisecarver | 294/169 |
| 5,184,653 | A * | 2/1993 | Lacy | 141/98 |
| 6,094,752 | A * | 8/2000 | Loshaw | 4/252.1 |
| 7,231,674 | B1 * | 6/2007 | Cernik | 4/661 |

* cited by examiner

*Primary Examiner* — Saul Rodriguez
*Assistant Examiner* — Gabriela Puig
(74) *Attorney, Agent, or Firm* — James A. Italia; Italia IP

(57) ABSTRACT

An apparatus for supporting a toilet is disclosed. The toilet is of the type having a waste outlet on a bottom thereof. The apparatus includes a platform having a top surface sized and shaped to contact at least a portion of the bottom of the toilet when the toilet is placed on the platform. A recess is formed in the platform and is open to the top surface and positioned on the platform such that the waste outlet of the toilet can be substantially aligned with the recess when the toilet is supported by the platform.

2 Claims, 3 Drawing Sheets

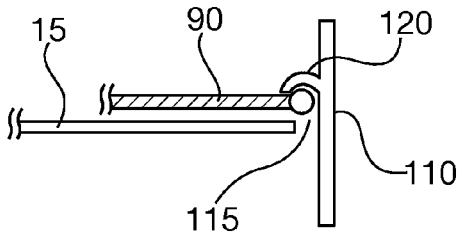
FIG. 5
FIG. 4
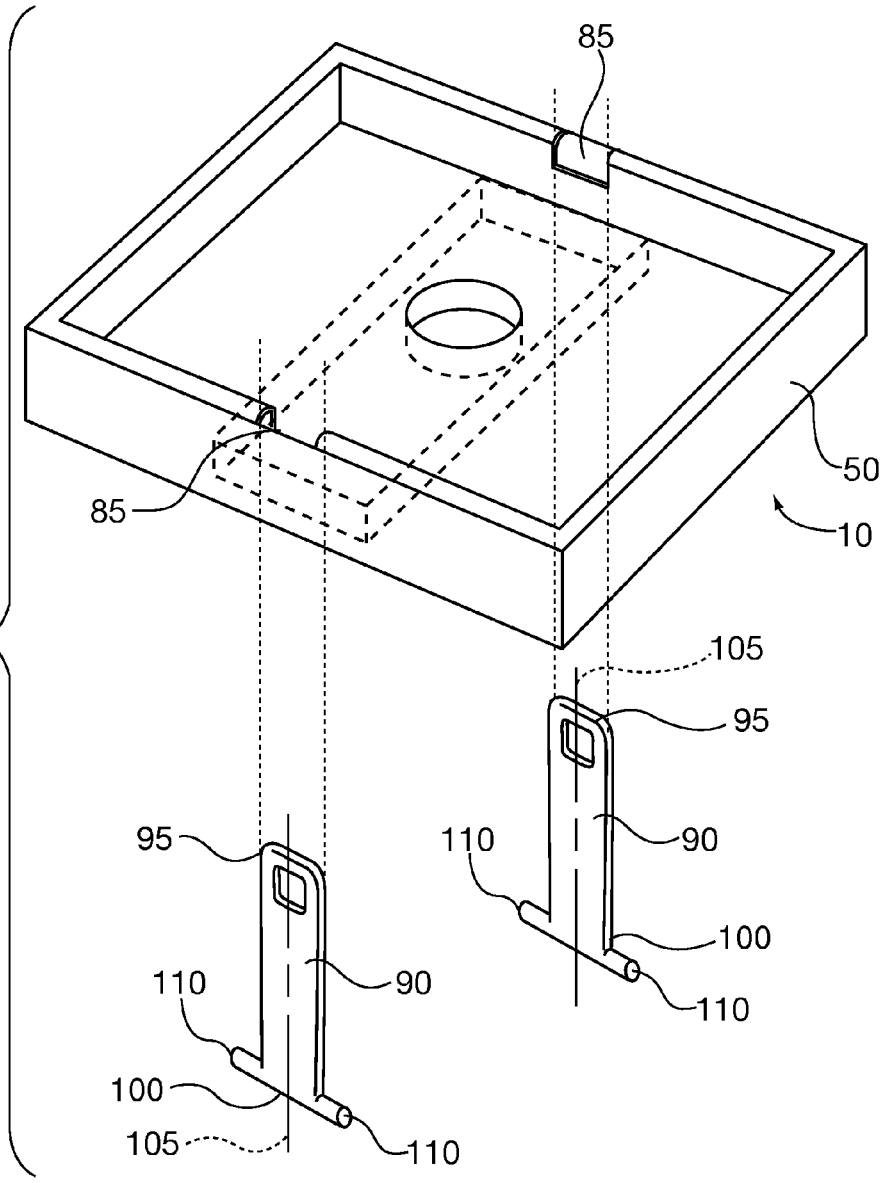

TOILET SUPPORT AND TRANSPORTING APPARATUS AND METHOD

BACKGROUND

This application relates generally to supporting and transporting toilets. More specifically, this application relates to a supporting and transporting device and a method for use when installing, replacing or transporting toilets.

SUMMARY

Currently when moving a toilet that has been in service any water, or soil, that may be left in the toilet trap, or stuck to the bottom of the toilet, can splash, or fall, onto the floor. Further, the area where the bottom of the toilet affixes to the building's waste line is generally quite messy. Any surface on which the toilet is placed is likely to get messy with soil, and/or water from the toilet, and/or wax from the spent wax ring used in a prior installation. Further, one technique used when installing a new toilet is to place the bottom, or bowl portion of the new toilet, i.e. with the tank removed, on the floor upside down thereby exposing the toilet's waste outlet. Then a wax ring is adhered to the bottom of the toilet concentric to the waste outlet by pushing sticky the ring onto to the toilet. Once the wax ring is in place the toilet must be turned over and the wax ring lined up concentric with the building's waste line in one motion generally without resting the bowl portion, and specifically without letting the wax ring touch anything which might deform it. This singular motion can be difficult.

Therefore, there is a significant need for an apparatus or method to enable placing a toilet onto a surface, and/or moving the toilet while keeping any underlying, or surrounding surfaces clean, and a need to enable positioning a replacement toilet, or reused toilet with a new wax ring in an upright position, at least temporarily, until the user is ready to place the toilet over the building's waste line.

This application discloses a toilet support and transport device that is economical to produce, of simple construction and capable of mass production, but also capable of providing a user a with a surface on which to place a toilet upright while the waste outlet area of the toilet is not in contact with any surface, and which protects the surrounding area from being dirtied with material from the toilet's waste outlet area.

In particular, this application discloses an apparatus for supporting and/or moving a toilet, the toilet of the type having a waste outlet on a bottom thereof. The apparatus comprising a platform having a top surface sized and shaped to contact at least a portion of the bottom of the toilet when the toilet is placed on the platform. The apparatus may have a recess formed in the platform and open to the top surface. The recess may be positioned on the platform such that the waste outlet of the toilet can be substantially aligned with the recess when the toilet is supported by the platform.

This application also discloses an apparatus for use with a toilet comprising a platform configured to support the toilet. A recess may be formed in the platform sized and shaped to allow one or more objects, or materials on a bottom side of the toilet to be positioned therein without substantially contacting the platform. One or more platform supports may be positioned under the platform and may be configured to support at least part of the weight of the toilet when the toilet is on the platform. A first handle may be hinge-ably coupled with a first side of the platform, and a second handle may be hinge-ably coupled with a second side of the platform. The first and second handles may have a first position extending from the platform and may be configured to allow the platform to be picked up, or dragged, or otherwise moved by one or more users grasping distal ends of the handles. The first and second handles may also have a second position, hinged over and positioned proximate to the platform.

Various operations may be described as multiple discrete operations in turn, in a manner that may be helpful in understanding embodiments of the present invention; however, the order of description should not be necessarily be construed to imply that these operations are order dependent.

Finally, this application discloses a method for supporting and/or carrying a toilet. In some embodiments the method may include placing the toilet on a platform, the platform having a recess therein. The platform may have supports thereunder to at least partially support the weight of the toilet. The supports may support the weight of the toilet at a spaced apart distance from an underlying surface. The method may also include positioning a waste outlet of the toilet over the recess, and allowing one or more objects, and/or a material, attached to a bottom of the toilet, at or adjacent the outlet, to hang, or fall, into the recess while the toilet is supported by the platform.

In some embodiments the method may also include positioning a bowl portion of the toilet, or a bowl portion of a replacement toilet, onto a surface in a first orientation with the waste outlet facing upwardly; positioning a wax ring substantially concentric with the outlet; turning the tank portion over to a second orientation with the waste outlet facing downwardly and positioning the tank portion on the platform such that the wax ring is suspended into the recess while the tank is supported by the platform; and then lifting the bowl portion while in the second orientation and positioning the waste outlet over and substantially concentric with a structure waste line and compressing the wax ring between the toilet and the structure waste line.

In some embodiments, prior to lifting the bowl portion, the method may also include moving the platform from a first location to a second location, the second location being relatively closer to the structure waste line than the first location. In some cases the moving the platform may include grasping handles hinge-ably coupled with, and on opposite sides of, the platform.

BRIEF DESCRIPTION OF THE DRAWINGS

The drawings, when considered in connection with the following description, are presented for the purpose of facilitating an understanding of the subject matter sought to be protected.

FIG. 4 is an exploded view of the embodiment shown in FIG. 2;

FIG. 5 is a partial cross-sectional view of another embodiment according to the invention.

DETAILED DESCRIPTION

Figure 3:
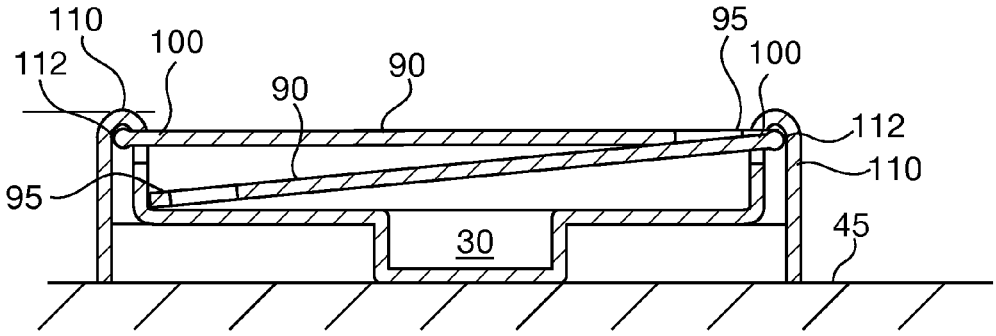
FIG. 3 is a is a cross-sectional view of the embodiment shown in FIG. 2 taken in a direction perpendicular the direction of the section is taken in FIG. 2.

While the present toilet support and transport device is described with reference to several illustrative embodiments described herein, it should be clear that the present invention should not be limited to such embodiments. Therefore, the description of the embodiments provided herein is illustrative of the present invention and should not limit the scope of the invention as claimed. In addition, while the following description references drawings showing particular configurations and proportions, it will be appreciated that the invention may be configured to have other configurations and proportions.

The description may use perspective-based descriptions such as up/down, back/front, and top/bottom. Such descriptions are merely used to facilitate the discussion and are not intended to restrict the application of embodiments of the present invention.

Referring now to FIGS. 1-6, a first embodiment of an apparatus 10 for supporting and/or moving a toilet is illustrated, the toilet of the type having a waste outlet on a bottom thereof. The apparatus 10 may be constructed from any sufficiently durable and resilient material such as metal, polymer, composite, etc. The apparatus 10 may include a platform 15 having a top surface 20 sized and shaped to contact at least a portion of the bottom 28 of the toilet 25 when the toilet 25 is placed on the platform 15. A recess 30 may be formed in the platform 15 and may be open to the top surface 20 and may be positioned on the platform 15 such that the waste outlet 35 of the toilet 25 may be substantially aligned with the recess 30 when the toilet 25 is supported by the platform 15. The apparatus 10 may be configured to support the platform 15 a spaced apart distance 40 from an underlying surface 45.

The recess 30 may be configured to catch any liquid or solid that may fall from the outlet 35. The recess 30 may also, or instead, be sized and shaped to allow one or more plumbing components fixed to the waste outlet 35 to extend into the recess 30, and to extend below the top surface 20 of the platform 15. In some cases the one or more plumbing components may be a wax ring (not shown). The wax ring may be a new wax ring, or a spent, i.e. used wax ring. The one or more plumbing components may be portions of a previously installed wax ring stuck to the bottom of the toilet around, or adjacent the waste outlet. The remaining portions of the spent wax ring may be stuck to the waste line of the plumbing system of the building where the toilet was installed.

The example platform 15 is illustrated herein as a rectangular platform. It will be understood that other platform shapes and configurations are possible, for example an oval or round shape, or a platform shaped to be form fitted for a particular toilet model, or size, or class of toilet.

In some embodiments the apparatus 10 may be made from a unitary construction, i.e. made from single piece by, for example, an injection molding operation. The apparatus 10 may be made from a unitary construction having sidewalls 50 extending upwardly from the top surface 20 of the platform. Other construction configurations are possible, for example, the sidewalls 50 may be attached to the platform via any suitable attachment means such as by using fasteners, or adhesives, or a snapping arrangement. The sidewalls 50 may extend upwardly from the platform. The sidewalls 50 and the platform in combination may form a tub 55.

Figure 1:
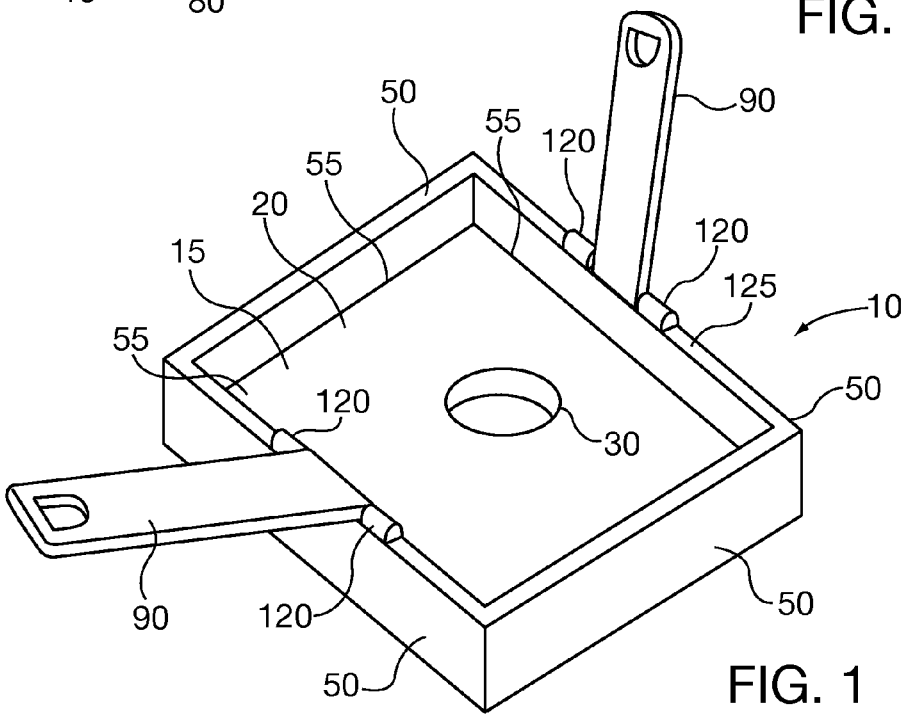
FIG. 1 is a perspective view of a first embodiment of a toilet support and transport apparatus.
Figure 6:
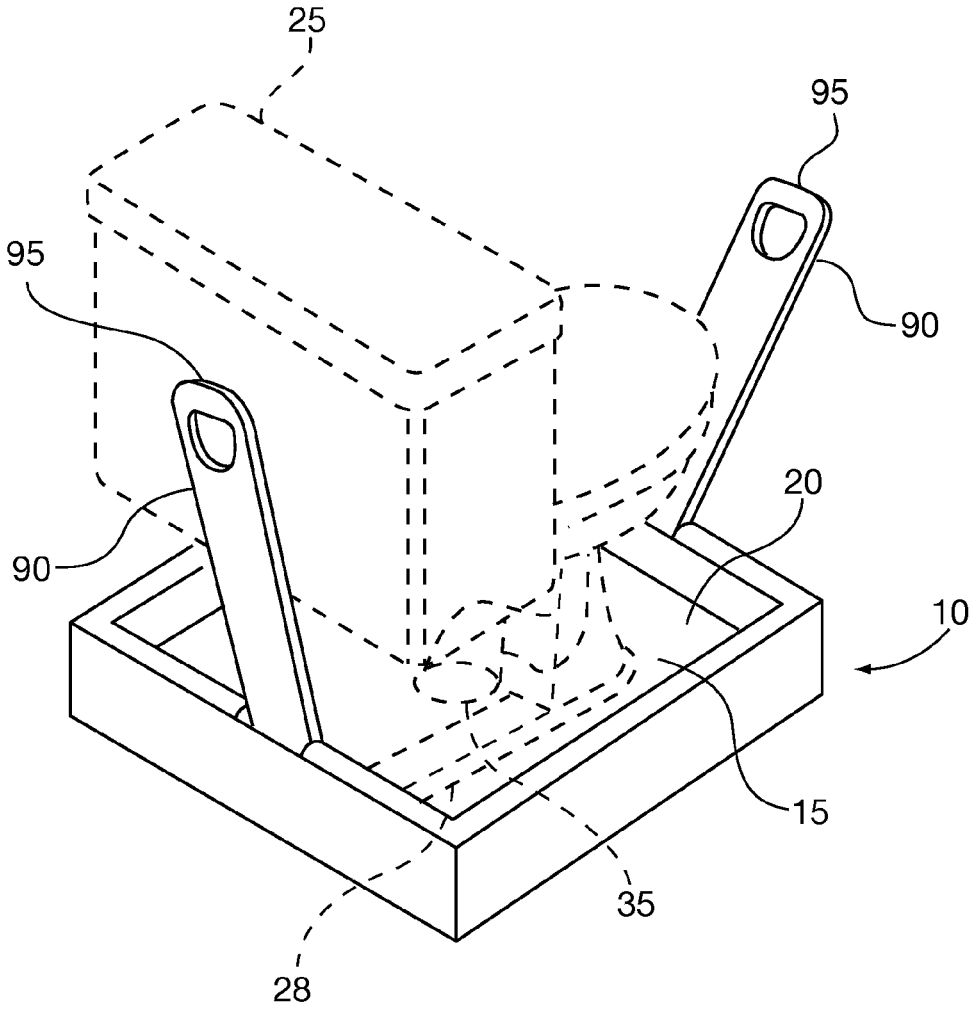
FIG. 6 is a perspective view of the embodiment shown in FIG. 2 with a toilet illustrated on the apparatus for support or transport.

FIG. 1 illustrates an example embodiment having sidewalls 50 constructed of four rectilinear members each coupled at an intermediate height above the underlying surface to four corresponding edges 55 of the platform 15. An example embodiment may include a plastic injection molded tub that may have, for example an overall size of 20 inches wide and 24 inches deep and a height of 5 inches. The tub may have, for example, a round 2 inch deep by 7 inch diameter recessed area molded into the main floor, or platform, of the unit. The recessed area may, in some embodiments, be centered on the platform. The bottom of the recessed area may be constructed to be even with the bottom of the sides of the unit, and may rest on an underlying surface. In this way the recessed area may, at least partially, support the weight of a toilet supported by the platform.

Figure 2:
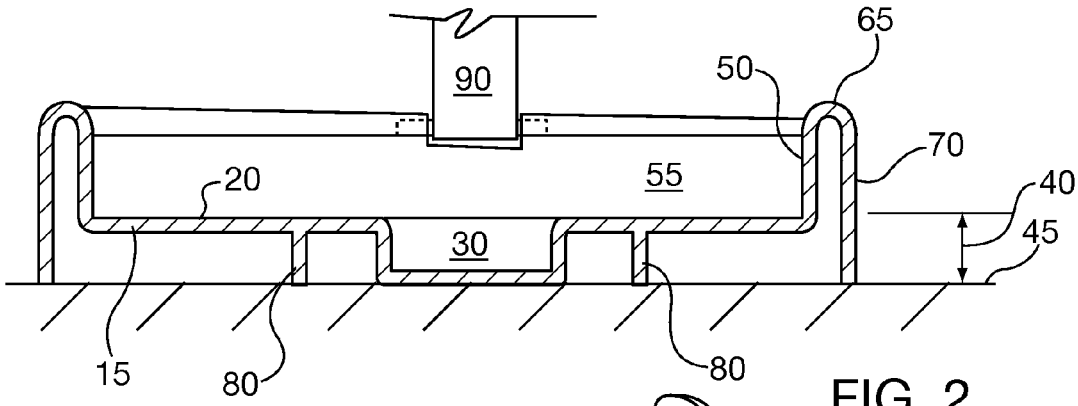
FIG. 2 is a cross-sectional view of another embodiment of a toilet support and transport apparatus showing two handles in a folded configuration.

Other configurations and dimensions are possible. For example, cross-sectional views FIGS. 2 and 3 illustrate sidewalls 50 coupled with and extending upwardly from the platform. A top element 65 may be coupled with and may extend substantially horizontally, or curvilinearly, from the sidewall 50. A support wall 70 may be coupled with and may extend downwardly from the top element 65. The support wall 70 may extend below the platform 15 and may be configured to at least partially support the platform 15 on the underlying surface 45.

The apparatus 10 may also include two or more handles coupled with the platform and configured to be used, for example, to move the apparatus with the apparatus 10 supporting the toilet 25. In some embodiments the top element 65 may have an opening 85 therein to facilitate attachment of one or more handles 90. The one or more handles 90 may each have a first end 95, a second end 100, and a longitudinal axis 105. The first end 95 may be configured to be grasped by a user. The second end 100 may have, for example, substantially cylindrical, or spherical, or the like, ears 110 extending outwardly in opposite directions from the second end 100. The opposite directions may be substantially perpendicular to the longitudinal axis 105 of the handle 90. The first end 95 of the handle 90 may be configured to pass through the opening 85 in the top element 65 and the ears 110 may be configured to seat within an underside 112 below the top element 65 on opposite sides of the opening 85. In some cases the apparatus may have a slot 85 in the sidewall 50 configured to allow a portion of the first end 95 of the handle 90 to pass such that the handle 90 can pivot toward the platform 15 about the ears 110.

Some embodiments may include supports 80 extending downwardly from a bottom surface of the platform 15. The supports 80 are illustrated as longitudinal walls in FIG. 3 extending normal to the drawing figure. Other arrangements are possible, for example, without limitation, supports extending radially from the recess 30, or concentric to the recess 30, or posts or the like. In some embodiments the supports may be arranged in substantially the shape of the bottom edge 28 of the toilet 25. In this way the weight of the toilet may be transferred substantially directly to the underlying surface 45.

Other embodiment may couple handles to the platform in various ways. FIG. 5 illustrates an example wherein an opening 115 is formed in the platform 15 and the handle 90 is configured to pass partway through the opening. Ears 110 on the handle are configured to be rotate-ably held in seat members 120. FIG. 1 shows an example wherein seat members 120 are located along a top edge 125 of the side walls 50. Ears that may be constructed the same, or similar to those already discussed may be included on handles 90 to hinge-ably couple with the seat members 120.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. An apparatus for supporting and/or moving a toilet, the toilet of the type having a waste outlet on a bottom thereof, the apparatus comprising:

a platform having a top surface sized and shaped to contact at least a portion of the bottom of the toilet when the toilet is placed on the platform;

a recess formed in the platform and open to the top surface and positioned on the platform such that the waste outlet of the toilet can be substantially aligned with the recess when the toilet is supported by the platform;

a sidewall coupled with and extending upwardly from the platform, a top element coupled with and extending from the side wall, and a support wall coupled with and extending downwardly from the top element;

an opening in the top element; and a handle having a first end a second end and a longitudinal axis, the first end configured to be grasped by a user, the second end having substantially cylindrical ears extending outwardly in opposite directions from the second end, the opposite directions being substantially perpendicular to the longitudinal axis of the handle, the first end of the handle configured to pass through the opening in the top element and the ears configured to seat below the top element on opposite sides of the opening.

2. The apparatus of clam 1 further comprising, a slot in the sidewall configured to allow a portion of the first end of the handle to pass such that the handle can pivot toward the platform.

* * * * *